US006095080A

United States Patent [19]

Weber

[11] Patent Number: 6,095,080

[45] Date of Patent: Aug. 1, 2000

[54] TILTING FRAME FOLD AWAY SWING BOOM SKIFF LIFT

[76] Inventor: Matthew Damon Weber, P.O. Box 2958, Friday Harbor, Wash. 98250

[21] Appl. No.: 09/416,746

[22] Filed: Oct. 13, 1999

[51] Int. Cl.[7] ..... B63B 23/00; B63B 23/02

[52] U.S. Cl. ..... 114/370; 114/365

[58] Field of Search ..... 114/365, 366, 114/97, 373, 374, 370

[56] References Cited

U.S. PATENT DOCUMENTS

| | | | |
|---|---|---|---|
| 915,118 | 3/1909 | Sanborn | 114/373 |
| 1,116,761 | 11/1914 | Thompson | 114/365 |
| 1,887,056 | 11/1932 | Hunt | 114/365 |
| 4,364,326 | 12/1982 | Pike | 114/369 |

*Primary Examiner*—S. Joseph Morano
*Assistant Examiner*—Patrick Craig Muldoon

[57] ABSTRACT

A transom mounted tilting frame fold away swing boom skiff lift for launching, retrieving and stowage of a tender or skiff on a larger yacht comprised of a twin swing boom davit arrangement contained within a tilting frame wherein the swing booms pivot on a common hinge allowing them to swing apart providing for suspended attachment of a skiff in the upright position or swing together forming compact nested configuration that can be folded aside when not in use clearing the yacht transom area for unrestricted access. The swing boom arrangement being substantially contained and pivotally attached to a double leg frame structure Frame structure to have pivotal bases mounted to the transom or swim step of a yacht allowing the frame structure to be tilted out and away from the transom of the yacht or upright and adjacent to the transom of the yacht. A motor box constructed integral to the top section of the tilting frame houses a motorized cable drum. One end of the cable being wound on the drum and the other anchored to a point on the yachts transom or aft section. A switch located in the aft section of the yacht activates the motorized cable drum. The drum rotates to play out cable, tilting the skiff lift back and down toward the water for launch or retrieval, or back in, returning the skiff lift back to the upright position adjacent to the yachts transom where swing booms can be nested and swung to one side clearing the swim step or stem area of the yacht.

4 Claims, 10 Drawing Sheets

TILTING FRAME FOLD AWAY SWING BOOM SKIFF LIFT

BACKGROUND OF THE INVENTION

The present invention relates in general to davits used on yachts or larger boats for the purpose of launching and retrieving a tender, skiff or life boat and more particular to a tilting frame swing boom skiff lift davit systems for storing, launching and retrieving small boats or skiffs have been known for some time and usually consisted of two large hanger type booms that would swing out or be hung out over the side of a larger vessel with a skiff or tender suspended from bow and stern by ropes or cable. Pulleys, blocks and winches suspending the skiff from the booms were used to raise or lower the skiffs when launching and retrieving This was usually a slow and difficult task as it required operators to synchronize their cranking rate on each of the winches controlling the bow or stern of the craft to insure the tender would be level to the water upon making contact., The more rope or cable that was paid out, the more the skiff would swing and sway from the davits making it harder to control. After successfully launching the skiff the next problem was to get it along side clear of all launching machinery and into position where it could be boarded. This whole operation was slow required a certain element of coordination and could be relatively dangerous depending on sea conditions. To day, most yachts carry a skiff for the purpose of shuttling the crew to shore and back while the yacht is at anchor and to serve as a safety or life boat. Stowage of these small boats or skiffs as well as ease and safety during launch and retrieval is an important factor in determining what type tender a vessel can carry.

The location of the skiff on the yacht, its accessibility after launching, the amount of space the skiff takes up and weather the skiffs stowed location will obstruct the skippers view while maneuvering the yacht are all important factors. Many yachts depend on their skiffs to add an additional margin of safety as life boats which could be used in emergency situations, so the ability to launch the tender quickly, safely and be able to board her in adverse conditions is of special concern to yacht skippers There are numerous types and styles of launching and retrieval systems in use today designed for the handling and stowage of tenders or small skiffs on yachts and larger vessels. The following are some examples of prior art.

PRIOR ART

N.S. Stephens Co. U.S. Pat. No. 3,834,338: Dingy Lifting Device shows a relatively light duty device fabricated from tubing and requiring the skiff to be pivoted up on its side during transport. This device is restricted in that it will only accommodate inflatable type skiffs the design also requires that device be stowed back into the upright position after the dinghy is launched restricting access to the swim step area of the yacht thus limiting access to the dinghy itself from the swim step area. When launching or retrieving a tender in adverse conditions wracking of the light weight tubular sections would certainly complicate the hook up or release procedure causing the operation to be questionable in terms of speed and safety.

Mountain Marine Inc. U.S. Pat. No. 4,961,398. Davit Assembly. Is another example of a lighter duty tubular constructed unit. Although this arrangement could be relatively compact when not in use, launching or retrieving even the lightest skiff could be an awkward task. The device requires that some sort of attachment or containment system be mounted to the end of each boom section for holding the skiff in place while manipulating the whole apparatus into the desired position for stowage of the skiff either in the horizontal or vertical position. It would be the writers guess that launching or retrieving a skiff from this system would be a two person operation Some unique clamping adaptation for containment of the skiff weather it is stowed in the horizontal or vertical position would be required.

U.S. Pat. No. 4,627,377 Davit Device, by Alain Zoonens represents a system that may be relatively easy to operate during launch and recovery. It would be difficult if not impossible however to integrate into a vessel with a swim step. The system dominates the aft section of the yacht both in terms of usable space outside the vessel and space required inside the vessel for the machinery and reservoirs required to operate the hydraulics. When stowed in the full up position there is substantial visual restriction to the stern area of the yacht. It is also a characteristic of hydraulic systems to be slow especially if they are small and produce good load carrying ability. This could be a negative feature in cases where emergency launching may be necessary. Although there are a considerable number of patented variations of the davit systems outlined in the above referenced patents none are known that provide solutions to the problems of launching, retrieving and stowing a tender or skiff as easily and safely as the tilt base swing boom skiff lift of the present invention

SUMMARY OF THE INVENTION

The principal object of the invention is to provide a skiff lift or davit system that provides quick, easy and safe launching of a skiff or tender from the stem area of a larger vessel. It is also an object to provide a device that is compact yet versatile in terms of the type tender or skiff that can be accommodated.

Another object is to provide a twin boom skiff lift or davit system that will lower the skiff to the water maintaining a level plane between bow and stern and securely contain the tender or skiff in an upright attitude from two points allowing for use of minimal length lifting bridals between the skiff and swing booms thus limiting the skiffs motion during launch, retrieval or while it is stowed.

A further object is to provide a skiff lift or davit system wherein the two booms can be nested together and folded out of the way when not in use clearing the launch area and providing unrestricted access to a swim step or the stern end of the vessel and to the skiff.

The forgoing objectives of the present invention can be accomplished by providing a tilting frame swing boom skiff lift arranged to carry a skiff in the upright position ready for launch with minimal length lifting bridals. Skiff lift to have a physical geometry and load carrying capacity that will accommodate conventional skiffs and tenders as well as soft and hard bottom inflatable dinghies. Skiff lift being comprised of a tilting frame with two legs and twin swing booms that are pivotally attached to the tilting frame on a common hinge. Swing booms extend out from the frame and angle up approximately 15 degrees from horizontal and are able to swing out approximately 90 degrees from each other. This allows the swing booms to locate over the centerline of the skiff or tender lift points and mate with skiff or tender utilizing short lifting bridals of cable, line or chain. Swing booms to have tension rods provided to increase load carrying capability of the swing booms and a bumper strap arrangement for limiting the angle the two swing booms can swing apart Tension rods being pivotally attached to the upper hinge tube portion of the skiff lift frame terminate as hangers for the lift bridals at the ends of the swing booms. A motor box which is an integrel part of the frame houses a substantially mounted electric motor driven cable drum system where one end of the cable is contained on the drum inside the motor box portion of the frame and the other end of the cable is secured to a fixed position on the transom or back deck of a yacht. The bottom of the frame legs are secured in tilting bases. Tilt bases are substantially mated to the transom or swim step of the yacht. A switch located on or near the stem of the yacht activates the motor cable drum to pay out or wind in cable drawing the motor box portion of the frame toward the transom of the yacht or allowing the motor box and frame to fall away from the yachts transom thus allowing the frame and swing booms to pivot or tilt back and down toward the water for launching a skiff or up and away from the water for retrieval of a skiff. Tilting of the entire frame and swing boom system together allows the skiff to be launched completely into the water or retrieved from the water using only minimal fixed length lifting bridals between the skiff and the swing booms resulting in complete containment of the skiff through the entire launch or retrieval exercise.

Mounting of the swing booms on a common hinge tube and frame provide the advantage of twin boom containment for launching, retrieving or stowing a skiff. Swing booms being mounted on a common hinge also provides for nesting of one swing boom inside the other when not in use allowing swing booms to swing to one side of the yacht when not in use clearing the aft section of the yacht for unrestricted access to the swim step or skiff.

BRIEF DESCRIPTION OF THE DRAWINGS

REFERRING NOW TO FIG. 1

Figure 1:
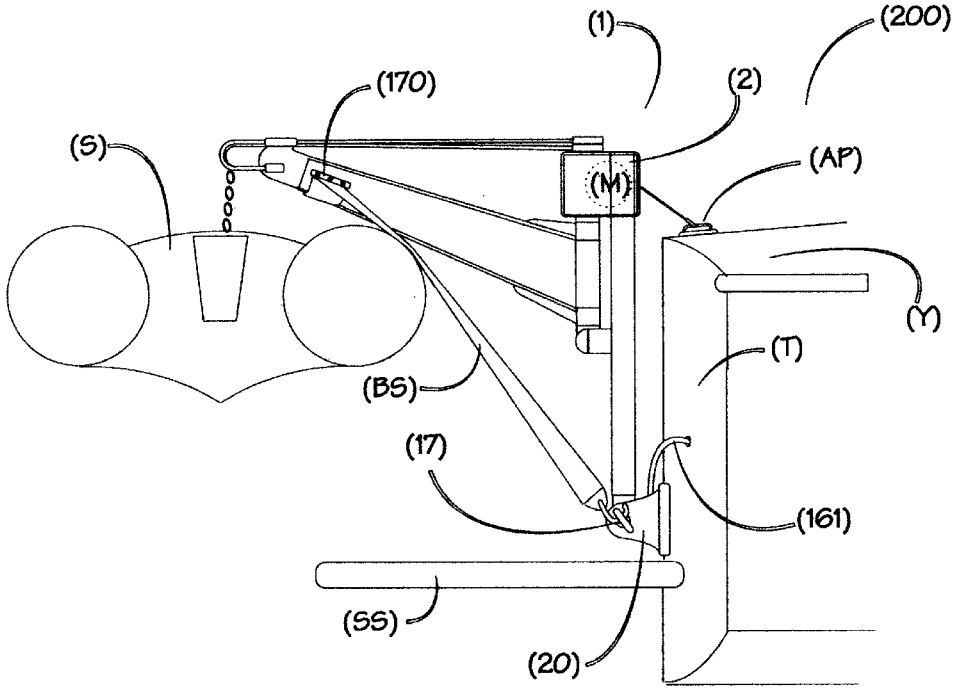
FIG. 1 Shows skiff lift of the present invention in full upright position with skiff loaded And bumper straps attached.
Figure 2:
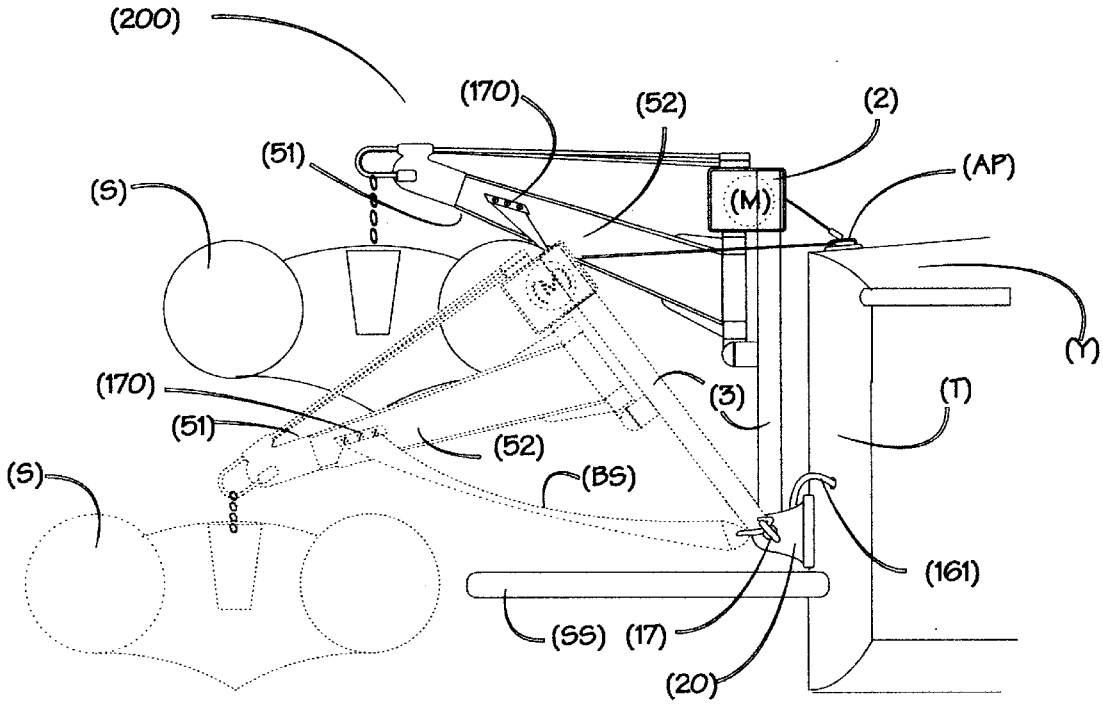
FIG. 2 Illustrates how skiff lift tilts downward launching and retrieval of skiff.

The Tilting Frame Fold Away Swing Boom skiff lift (200) as shown in FIG. 1 comprises a tilting frame, Swing boom system providing for suspending a small boat or skiff with lifting bridals (LB) during transport, launching or retrieving. Skiff lift (200) frame (1) is substantially mounted to yacht (Y) utilizing two tilt mount bases (20). Tilt mount bases (20) are substantially bolted to yacht (Y) transom (T) or a substantial horizontal surface such as a swim step (SS). skiff lift (200) is provided with bumper strap (BS) Bumper strap (BS) to be approximately 4" wide nylon webbing fixed to outside swing boom (51) and inside swing boom (52) with screw plates (170) located approximately in areas shown in FIG. 1. Bumper strap (BS) to be a single length of webbing. Bumper straps (BS) middle section extends between outside swing boom (51) and inside swing boom (52) for the purpose of tying the two swing booms together thus limiting their maximum spread in relation to each other. Bumper strap (BS) ends to be provided with snap type connectors and be of a length that will allow them to extend back to eye bolts (17) on tilt mount (19) limiting side to side movement of swing booms, providing additional containment of skiff (S) and serving as motion dampers between skiff (S) and swing booms (51 and (52). Motor box (2) is an integral part of skiff lift frame (1) and houses an electrical or hydraulic motor (M) which drives a cable drum. End of cable opposite the drum is substantially anchored (AP) to convenient location on yacht (Y). Motor (M) is powered through power cord (161) which passes from motor (M) down through frame leg (3) and into yacht (Y) transom (T) where it is connected to a power source and switching mechanism. By actuating motor driven cable drum (M) from a switch located in the aft area of yacht (Y), skiff lift (200) frame (1) tilts downward (See FIG. 2) positioning swing booms (51) and (52) to a convenient height above the water for launching or retrieving small boat or skiff (S).

Figure 3:
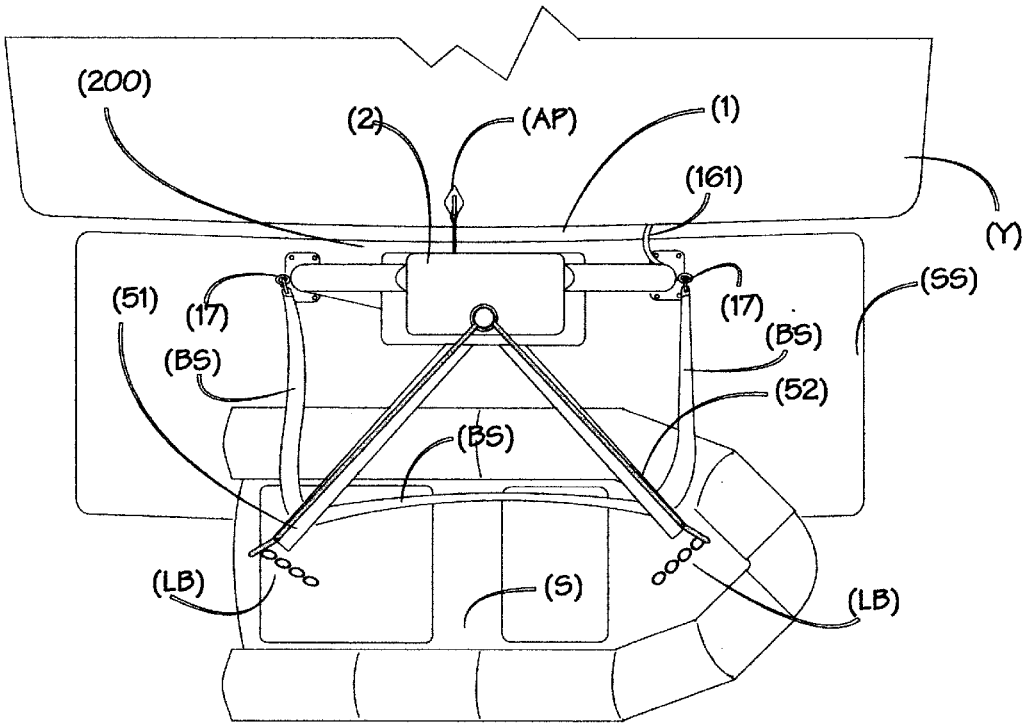
FIG. 3 Top view of skiff lift with booms spread and skiff loaded

Referring now to FIG. 3, showing a top view of skiff lift (200) of the present invention with skiff (S) in the loaded or stowed position. Swing booms (51) and (52) pivoted outward supporting skiff (S)with lifting bridals (LB) both bow and stem. Bumper strap (BS) substantially fixed between swing booms (51) and (52) and to yacht (Y) or swim step (SS) to contain skiff (S) and reduce excessive motion of swing booms and skiff (S) while yacht (Y) is under way.

Figure 4:
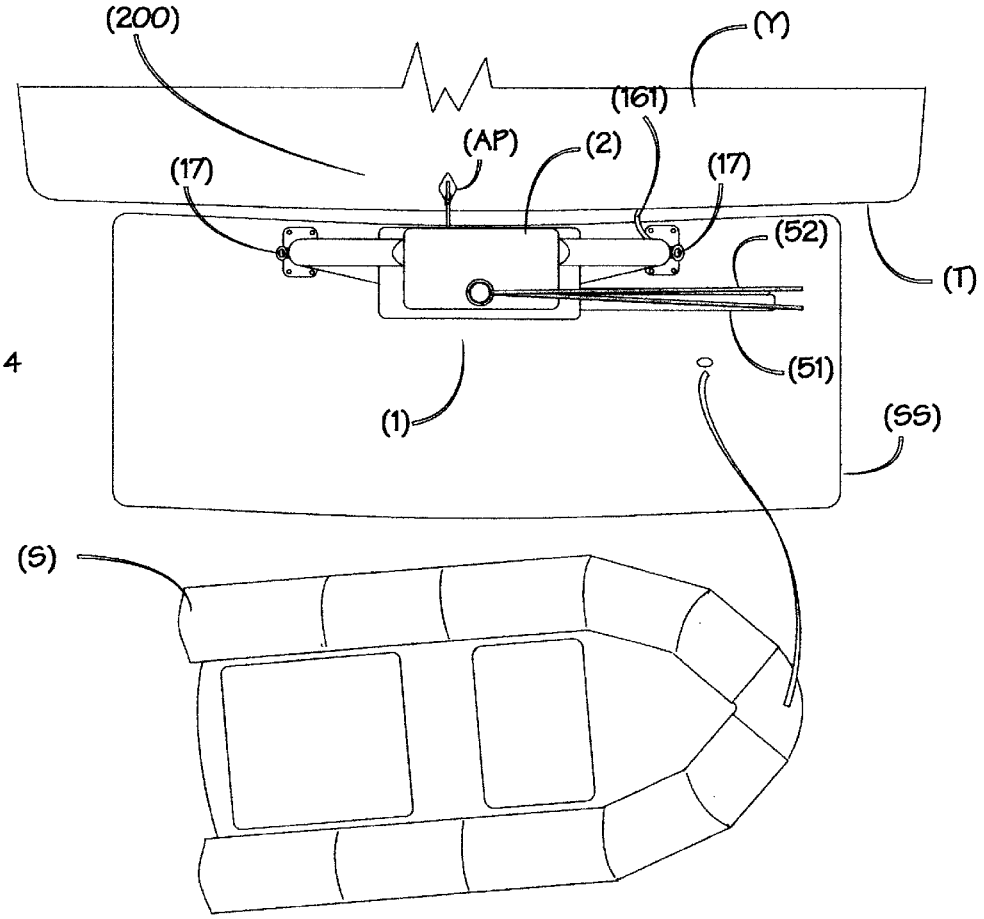
FIG. 4 skiff launched and swing booms stowed to one side for better access to swim step FIG. 5 Shows frame of tilt base swing boom skiff lift with and intrigal motor box FIG. 6 Illustrates details of motor box FIG. 7 Side views of inside and outside swing booms FIG. 8 Illustrates inside and outside swing boom bearing arrangements and a perspective View of the bearing components prior to welded attachment to the swing booms FIG. 9 Shows outside swing boom end casting FIG. 10 Shows inside swing boom end casting FIG. 11 Shows tension rod and tension rod bearing arrangement FIG. 12 Tension rod geometry FIG. 13 Blow up of skiff lift assembly

FIG. 4 shows skiff (S) launched and tethered to yacht (Y) and swing booms (51) and (52) nested and stowed to one side of yacht (Y) clearing swim step (SS) for usable access.

Figure 5:
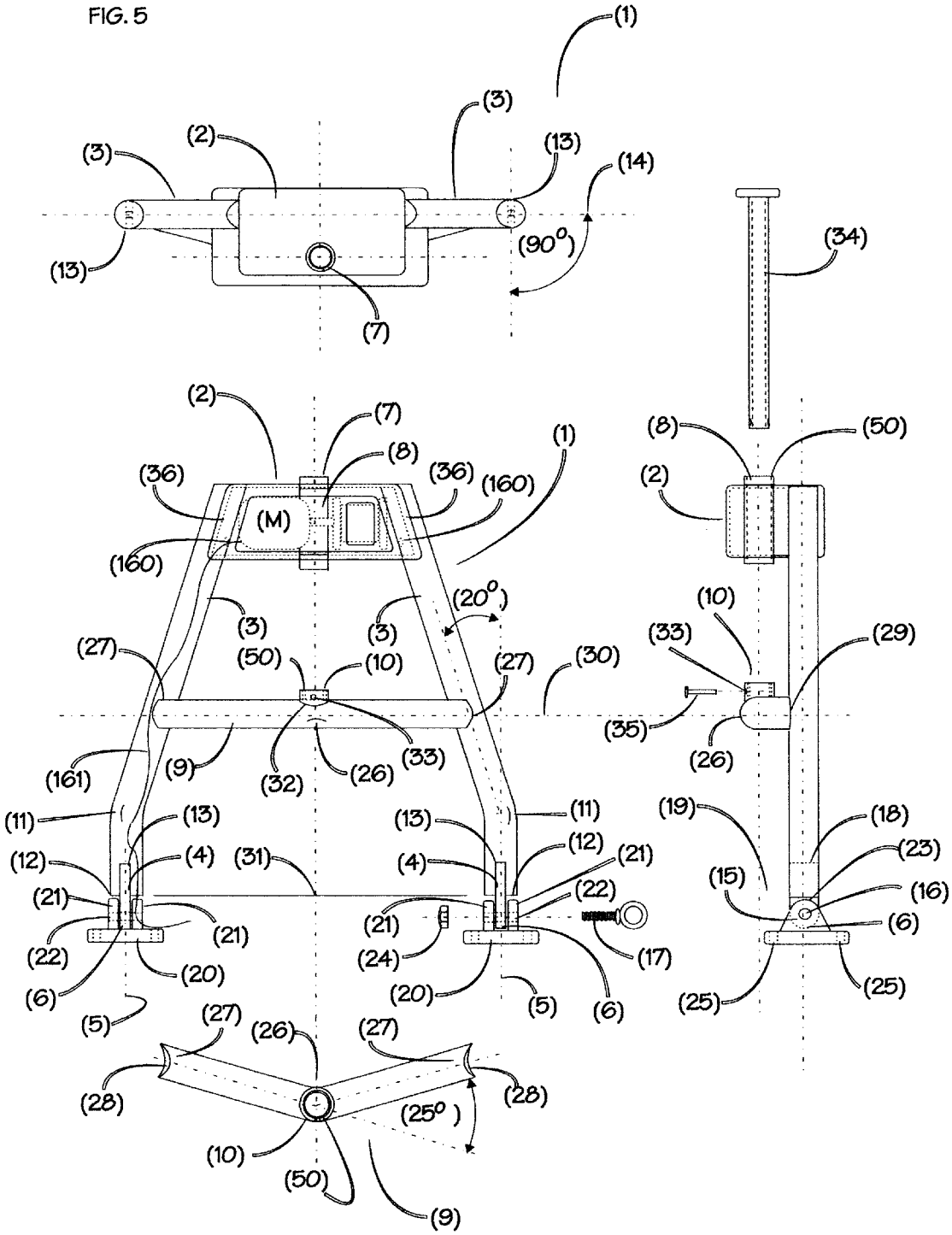

Referring now to FIG. 5. The preferred embodiment of the tilting frame swing boom skiff lift of the present invention is comprised of a frame (1) legs (3) and an intrigal motor box (2). Approximate dimensions of for the preferred embodiment are as follows. 40" between tang centers (5) on leg bases (12). Approximate overall frame height to be 45" measured from bottom (6) of mounting tangs (4) to top surface (7) of upper hinge tube bearing (8). Frame (1) constructed of 3" diameter heavy wall aluminum pipe including legs (3), cross bar (9), Upper hinge tube bearing (8) and lower hinge tube bearing (10). Motor box (2) to be fabricated as a sub assembly from ¼" aluminum plate to approximate dimensions outlined in figure FIG. 6 Legs (3) are constructed as mirror images of each other and consist of a length of 3" Diameter heavy wall aluminum pipe approximately 46" long with a 20 degree bend at (11) Bend is approximately 11" up from leg base (12) Leg base (12) to have ¾" slot (13) cut at 90 degrees from frame leg bend axis (14) to accommodate substantial welded attachment of frame mounting tangs (4). Frame mounting tangs (4) to be fabricated from ¾" aluminum plate to a dimension of 3" wide and 7" long. Tangs (4) to be provided with radius (15) of approximately 1 ½" on bottom end. Tang (4) provided with a ¾" thru hole at the center of radius (16) to provide for ¾" bolt (17). Square end (18) of frame mounting tangs (4) to be substantially welded at all surfaces adjacent to slots (13) cut in leg bases (12). Through hole (16) to have clearance to provide for ¾" eye bolt (17) utilized for mating frame (1) to tilt mount (19) and attaching snap end of bumper strap (BS). Tilt mount (19) constructed of fabricated or cast aluminum comprising base (20) approximately 1" thick and Cheeks (21) approximately ¾" thick. Clearance between cheeks (21) to be approximately 1" to allow for loose fit of tangs (4) Cheeks (21) to be provided with ¾" hole (22) at approximate center of radius (23) to accommodate ¾" eye bolt (17). Bolt (17) to pass through hole (22) in cheeks (21) and through hole (16) in tangs (4) to provide for pivotal mechanical attachment of legs (3) to tilt mount base (19). Nut (24) provided for threaded attachment to eye bolt (17) Base (20) to be provided with 4 holes (25) for attachment of tilt mount (19) to yacht (Y) either in transom (T) (see FIG. 1) or swim step (SS) (see FIG. 3)

Cross bar (9) comprised of 3" diameter heavy wall aluminum pipe approximately 35" in length is provided for the purpose of securing the left Leg (3) to right leg (3) and provide for mounting of lower hinge tube bearing (10). Cross bar (9) is provided with a bend of approximately 25 degrees at point (26). Point (26) being equal in distance from cross bar ends (27). Cross bar ends (27) to be coped (28) prior to welding to insure proper fit to left leg (3) and right leg (3). Cross bar (9) to be substantially welded to left leg (3) and right leg (3) at point (29). Point (29) to be located approximately 19" from horizontal centerline (30) of cross bar (9) to point (31) Point (31) to be on the same horizontal plane as leg bases (12) and measured equidistant from right leg base (12) and left leg base (12). Cross bar (9) to provide for substantial welded attachment of lower hinge tube bearing (10). Lower hinge tube bearing (10) comprised of 3" Diameter heavy wall aluminum pipe approximately 2" long. Lower hinge tube bearing (10) to be coped at it's base (32) to provide for proper fit to cross bar (9) when substantially centered on cross bar (9) and orientated in a vertical position at point (26) insuring proper axial alignment with upper hinge tube bearing (8) in motor box (2) Lower hinge tube bearing (10) to be substantially welded in place Lower hinge tube bearing (10) to have ⅜" hole drilled through the diameter approximately at point (33). Hole to provide for hinge tube (34) retaining pin (35) providing mechanical attachment of lower hinge tube bearing (10) and hinge tube (34) when tilt base swing boom skiff lift (200) is fully assembled.

Figure 6:
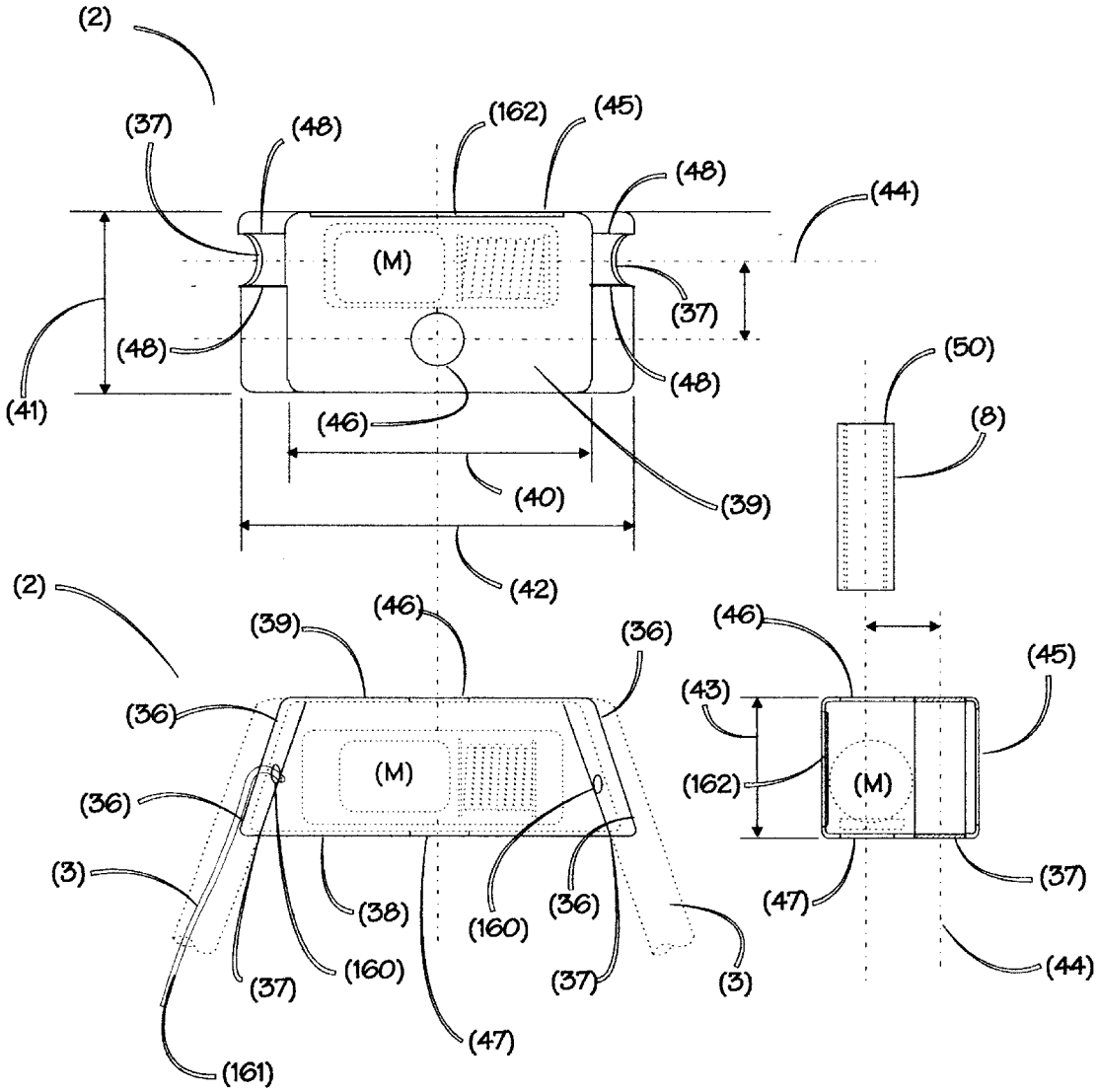

Now Referring To FIG. 6

A motor box (2) is provided to house motor and cable drum system (M), contain upper hinge tube bearing (8) and provide for structural integrity of frame (1) by substantial welded connection of motor box (2) and legs (3). Motor box (2) to be fabricated utilizing ¼" aluminum plate comprising the approximate geometry as follows. Top surface (39) to be approximately 18" long (40) and 9" wide (41). Bottom surface (38) to be approximately 25" long (42) and 9" wide (41). Motor box (2) height (43) to be approximately 8". Motor box (2) back (45) to be substantially cut out (162) to allow for installation service or removal of motor drum (M) Center line (44) of legs (3) to be approximately 3" from back surface (45) of motor box (2). Motor box to provide for two 3" diameter holes to accommodate upper hinge tube bearing (8). Hole (46) substantially cut through top surface (39) of motor box (2) Hole (46) center location to be ½ the top surface (39) length (40) and 4" out from leg (3) centerline (44). Hole (47) to be substantially cut through bottom surface (38) of motor box (2) Hole (47) center location to be ½ bottom surface (38) length (42) and 4" out from leg (3) centerline (44). Holes (46) and (47) to be cut slightly oversize to allow for accurate alignment of upper hinge tube bearing (8) when welding upper hinge tube bearing (8) into motor box (2). Coped surfaces (37) and straight wall surfaces (48) of motor box (2) to be substantially welded to the top inside surfaces (36) of the upper right and upper left legs (3). Inside surface (36) Of legs (3) to have approximately ½" hole (160) drilled substantially through 1 wall to accommodate motor drum (M) power cord (161). Power cord (161) to exit leg (3) through open end of leg base (12) between inside wall of leg (3) and tang (4). (see FIG. 1)

Upper hinge tube bearing (8) is provided to support upper end of hinge tube (34) in motor box (2) portion of frame (1). Upper hinge tube bearing (8) to be comprised of 3" heavy wall aluminum pipe approximately 10" in length, and sleeved with friction reducing plastic or composition plastic material (50). Upper hinge tube bearing (8) to be substantially welded into hole (46) in motor box (2) top surface (39) and hole (47) in bottom surface (38) providing upper pivotal support for hinge tube (34).

Figure 7:
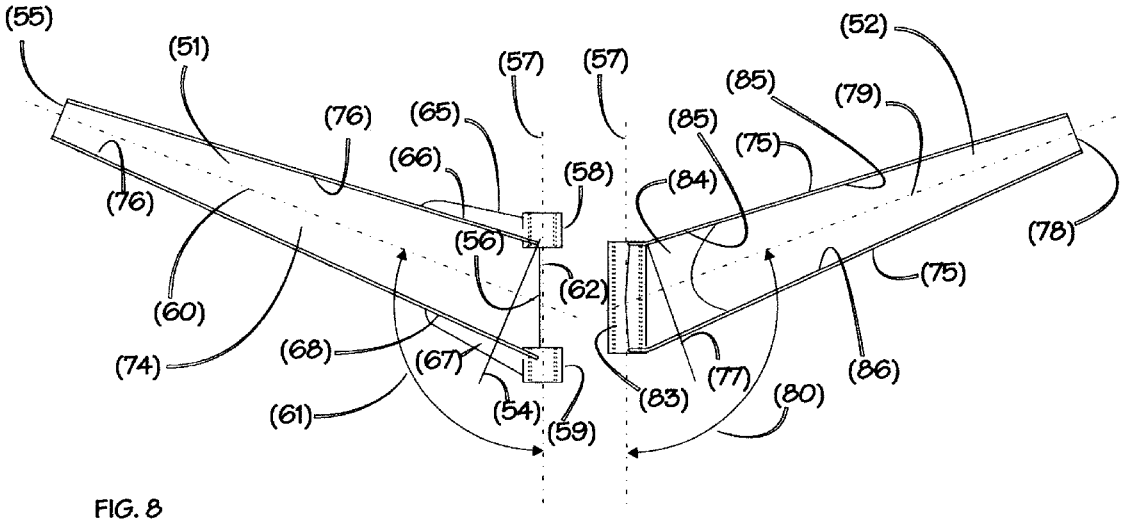

Referring now to FIG. 7

A nesting swing boom arrangement is provided for mounting on a common hinge tube in frame (1) (see FIG. 2) for the purpose of lifting a skiff or dingy from the water or placing the skiff or dingy into the water. It may be desirable to construct the swing booms and or any of their components of a composition or reinforced fiberglass material which could result in cost savings for lighter duty models. For the purpose of the following detailed description, the preferred embodiment of the swing boom arrangement of the present invention comprise one outside swing boom (51) and one inside swing boom (52). Each swing boom consisting of a fabricated aluminum channel, a bearing arrangement (53) (see FIG. 8) and end castings (91) and (92) (see FIG. 9 and 10). Swing booms are constructed of ¼" aluminum plate and are similar to each other only in geometry as actual physical dimensions are different allowing inside swing boom (52) to be nested in channel cavity (74) of outside swing boom (51). Bearing configurations (53) (see FIG. 8) for outside swing boom (51) and inside swing boom (52) are also different allowing swing booms to swing a full 180 degrees in their nested position or independently (see FIG. 3).

Figure 8:
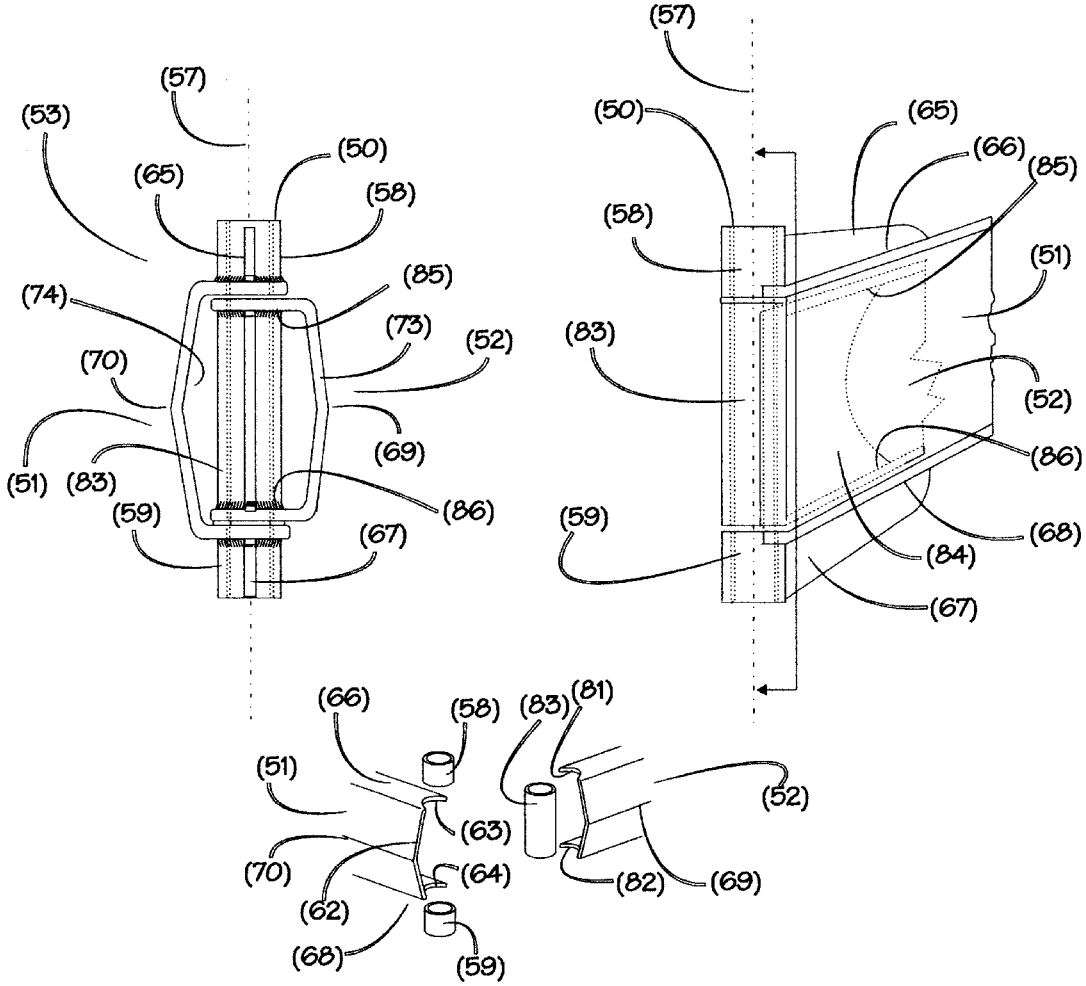

Outside swing boom (51) is comprised of a tapered section of fabricated aluminum channel incorporating a stiffening bend (70) (see FIG. 8). Base cross section (54) is approximately 8", measured at right angles to outside boom centerline (60). Cross section (54) of outside swing boom (51) tapers down to approximately 4" measured at right angles to boom centerline (60) at tip (55). Length of outside swing boom (51) measured from intersect point (56) of hinge tube centerline (57) and Outside swing boom centerline (60) to the point where outside boom centerline (60) intersects tip (55) of outside swing boom (51) is approximately 52". Welded attachment of outside swing boom bearings (see FIG. 8) to be arranged to allow for outside swing boom (51) to be fixed in an angled up position to where Center line (60) of outside swing boom (51) intersects with hinge tube center line (57) forming angle (61). Angle (61) to be approximately 105 degrees. Outside swing boom tip (55) to be substantially at right angle to outside swing boom centerline (60) to provide proper alignment and mating surface for welded attachment of outside end casting (92). (see FIG. 9)

Referring now to FIG. 8

Outside swing boom (51) to be provided with two hinge tube bearings which enable 180 degree pivoting of outside swing boom (51). Hinge tube bearings to be constructed of 3" heavy wall aluminum pipe section, each approximately 2" long, Upper hinge tube bearing (58) to be substantially welded to coped surface (63) of upper channel surface (66)

on base end (62) of outside swing boom (51). Lower outside hinge tube bearing (59) to be substantially welded to coped surface (64) of lower channel surface (68) on base end (62) of outside swing boom (51) Bearings to be welded forming a geometry that will provide for axial alignment of upper and lower hinge tube bearings with each other and maintain substantially perpendicular orientation of outside swing boom (51) to frame (1) when assembled on hinge tube (34) (see FIG. 13). Upper hinge tube bearing (58) and lower hinge tube bearing (59) to be provided for with friction reducing plastic or composition plastic liners (50).

Outside swing boom upper hinge tube bearing (58) and lower hinge tube bearing (59) to be provided with strengthening gussets constructed of ¼" aluminum plate. Upper hinge tube bearing gusset (65) to mate with outside diameter of upper hinge tube bearing (58), and extend approximately 5" along top of outside swing boom (51) upper channel surface (66). Upper hinge tube bearing gusset to be substantially welded to outside diameter of upper hinge tube bearing (58) and outside swing boom upper channel surface (66). Lower hinge tube bearing gusset (67) to mate with outside diameter of lower hinge tube bearing (59) and extend along lower channel surface (68) for a distance of approximately 5". Lower hinge tube bearing gusset (67) to be substantially welded to the outside diameter of lower hinge tube bearing (59) and lower channel surface (68) of outside swing boom (51).

Figure 9:
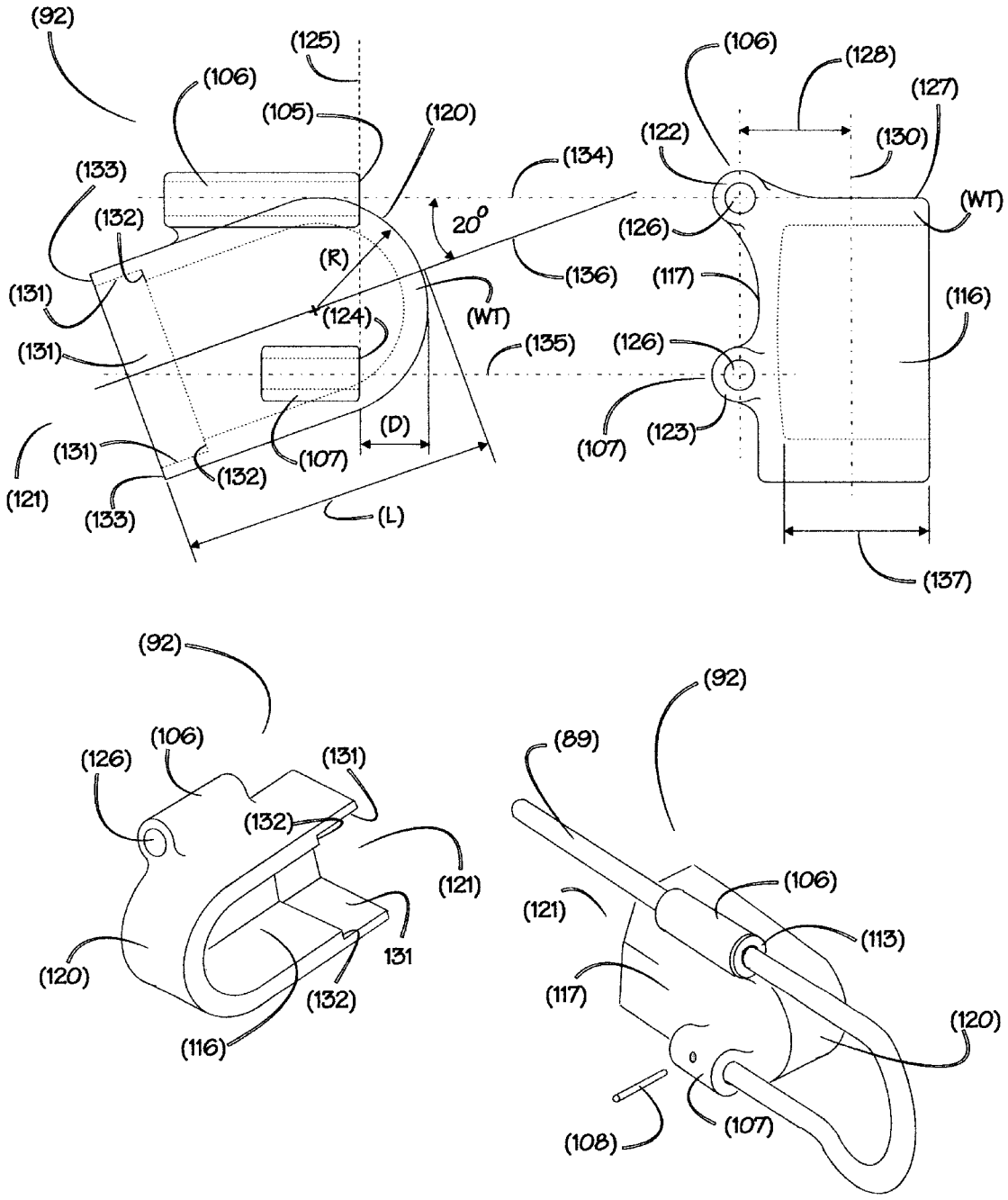

Referring now to FIG. 9

Outside swing boom (51) end casting (92) comprises an aluminum casting. Casting (92) is approximately 6" long (L) and comprises an outboard end (120) rounded and substantially closed with an outside radius (R) of 2 ¼" and a wall thickness (WT) of ½". An inboard end (121) to be open and have geometry for interface and substantial welded attachment to outside swing boom tip (55) (see FIG. 7). Open side (116) depth (137) to be approximately 3" to provide for nesting of inside swing boom casting (91) (see FIG. 10) and one closed side (117) providing for the cast inclusion of upper rod guide (106) and lower rod guide (107). Upper rod guide (106) to be approximately 4" inches long and have a minimum wall section (122) of approximately ¼". Lower rod guide (107) to be approximately 2" long with minimum wall thickness (123) to be approximately ¼"

Face (105) of upper rod guide (106) and face (124) of lower rod guide (107) to share the same vertical plane (125). Two rod guide holes (126) to be 0.625" in diameter to provide clearance for tension rod (89). Center hole (126) center of upper rod guide (106) to be approximately on the same horizontal plane as surface (127) at top of radius (R) and set back approximately 1 ½" (D) from of outside radius (R) of swing boom casting (92). Center distance between upper and lower rod guide holes (126) to be approximately 3 ⅝" Upper and lower rod guide holes (126) centers to be offset (128) approximately 2" from vertical centerline (130) of inside cavity (116) of end casting (92) to provide for additional clearance between outside swing boom tension rod (89) and inside swing boom tension rod (90) (see FIG. 10) when swing booms are nested. (see FIG. 4) Open end (121) of end casting (92) to be provided with relieved surfaces (131) measuring approximately 1" in depth with shoulders (132) of ¼" to provide for the substantial mating and welding of tip (55) of outside swing boom (51) (see FIG. 7) to end casting (92). An additional weld to be provided for substantially mating outside edge (133) to adjacent surfaces on outside swing boom (51) tip (55).

Figure 13:
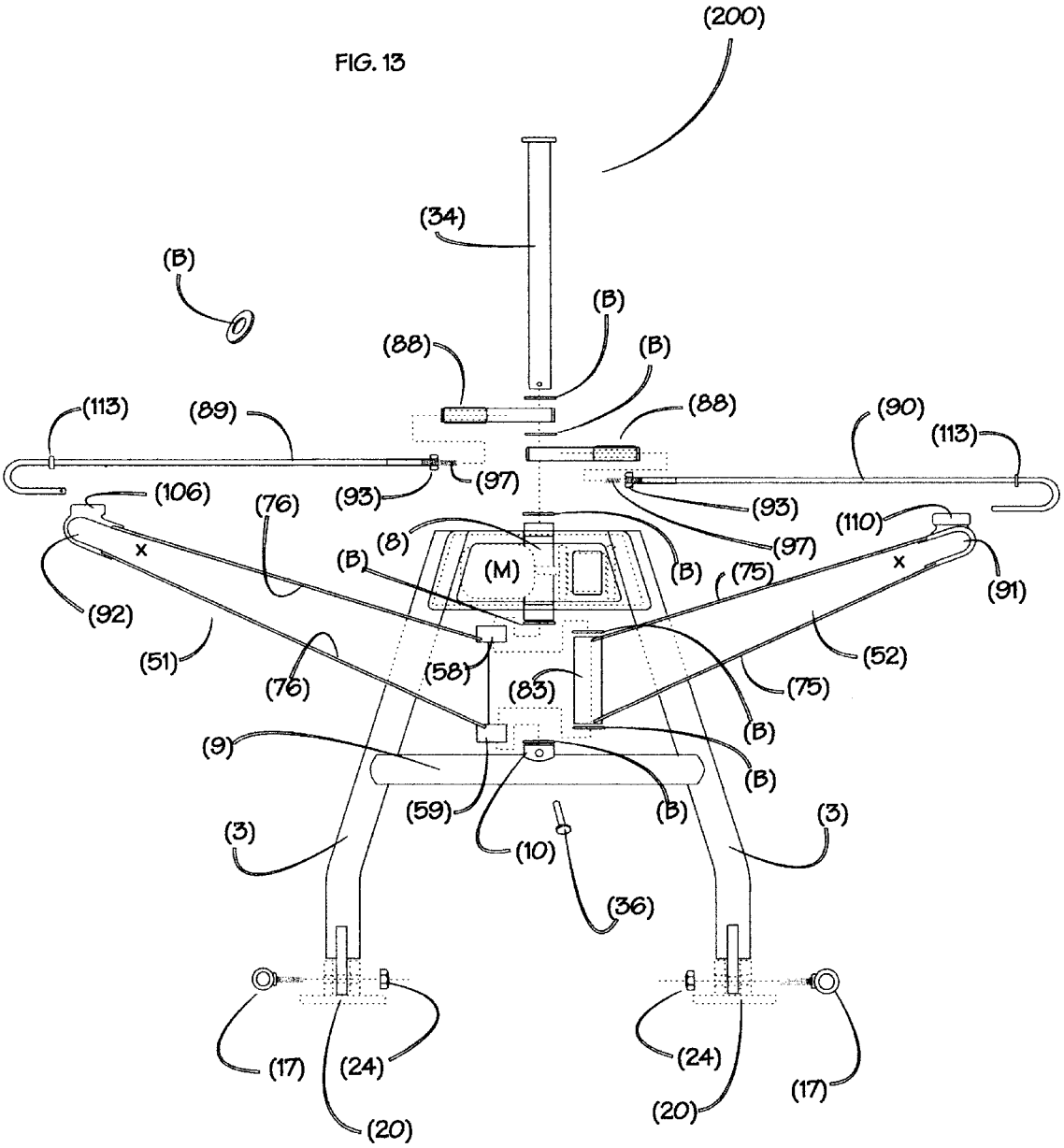

Longitudinal centerline (134) of upper rod guide (106) and longitudinal centerline (135) of lower rod guide (107) to intersect end casting centerline (136) by approximately 20 degrees providing for parallel orientation of upper rod guide (106) with lower rod guide (107) and providing for an approximately horizontal plane and proper alignment for tension rod (89) to pass substantially through upper rod guide (106), seat into lower rod guide (107) and maintain axial alignment for mating with tension rod bearing (88) on hinge tube (34) (see FIG. 13)

Referring again to FIG. 7

Inside swing boom (52) is comprised of a tapered section of fabricated aluminum channel modified with stiffening bend (69) along centerline (79) of inside swing boom (52). cross section geometry (73) (see FIG. 8) of inside swing boom (52) allows for nesting of inside swing boom (52) into channel cavity (74) of outside swing boom (51) with clearance of approximately ¼" between outside surfaces (75) of inside swing boom (52) and inside surfaces (76) which form channel cavity (74) of outside swing boom (51) allowing swing booms to be nested together (see FIG. 4) for stowage when not in use Base cross section (77) of inside swing boom (52) to be approximately 7". Inside swing boom (52) tapers to approximately 3" at tip section (78) Inside swing boom (52) to measure approximately 52" from intersection of hinge tube centerline (57) and inside swing boom centerline (79) to intersection of inside swing boom centerline (79) and tip section (78). Inside swing boom (52) bearing configuration (see FIG. 8) to be substantially welded to inside swing boom (52) allowing swing boom (52) to be angled up relative to swing boom centerline (79) and hinge tube centerline (57) to form angle (80). Angle (80) to be approximately 105 degrees. Inside swing boom tip (78) to be cut at right angle to swing boom centerline (79) to provide for proper mating surface for welded attachment of inside swing boom (52) end casting (91). (see FIG. 10)

Inside swing boom (52) to be coped at upper channel surface (81) and lower channel surface (82) to provide for proper welding joint fit with outside diameter of hinge tube bearing (83). Hinge tube bearing (83) of inside swing boom (52) to be a single bearing constructed of 3" heavy wall pipe section approximately 7 ¼" long. Hinge tube bearing (83) to be substantially welded to inside swing boom (52) upper channel coped surface (81) and lower channel coped surface (82). Care must be taken to insure axial alignment of inside hinge tube bearing (83) with outside swing boom bearings (58) and (59) and perpendicular orientation of inside swing boom cross section (73) to frame (1). Overall geometry of inside swing boom (52) must be fabricated to insure approximately ¼" clearance between inside swing boom outside surfaces (75) and inside surfaces of outside swing boom cavity (74). Base of inside swing boom to be provided with a single gusset (84). Gusset to be fabricated of ¼" aluminum plate cut to extend approximately 5" out from hinge tube bearing (83) Gusset (84) to be substantially welded to inside surface (85) of upper channel face, inside surface (86) of lower channel face and outside diameter of hinge tube bearing (83).

Figure 10:
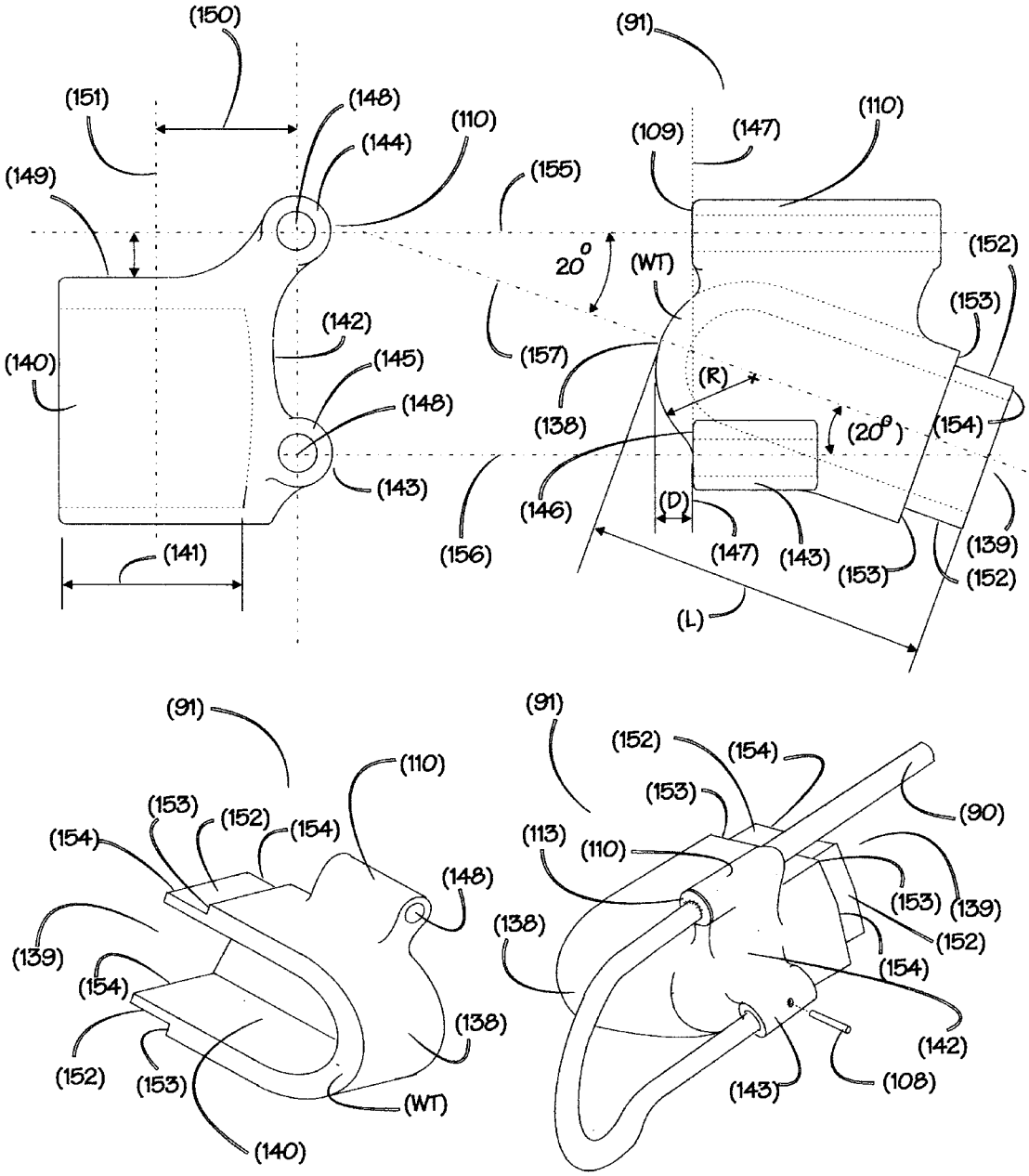

Referring now to FIG. 10

Inside swing boom end casting (91) comprises an aluminum casting of approximately 6" in length. Outboard end (138) of end casting (91) to have a radius (R) of 1 ½" and a wall thickness (WT) of ½". End (138) to be substantially closed. Inboard end (139) to be open and have geometry for interface and substantial welded attachment to inside swing boom (52) tip (78). (See FIG. 7) Open side (140) depth (141) to be approximately 3". Side (142) of end casting (91) to be substantially closed providing for the cast inclusion of upper rod guide (110 and lower rod guide (143). Upper rod guide (110) to be approximately 4" inches long and have a minimum wall section (144) of approximately ¼". Lower rod guide (143) to be approximately 2" long with minimum wall thickness (145) to be approximately ¼".

Face (109) of upper rod guide (110) and face (146) of lower rod guide (143) to share the same vertical plane (147) and be set back ⅝" (D) from outside radius (R) on end casting (91). Two rod guide holes (148) to be 0.625" in diameter and provide clearance for tension rod (90). Center hole (148) of upper rod guide (110) to be approximately ¾" above horizontal plane surface (149) of inside swing boom end casting (91). Center distance between upper and lower rod guide holes (148) to be 3 ⅝". Upper and lower rod guide holes (148) centers to be offset (150) approximately 2" from end casting inside cavity vertical centerline (151) to provide for additional clearance between outside swing boom tension rod (89) and inside swing boom tension rod (90) when swing booms are nested. (see FIG. 4)

Open end (139) of end casting (91) to be provided with clearance surfaces (152) approximately 1" in depth and shoulders (153) of ¼" to provide for substantial mating and welding of tip (78) of inside swing boom (52) to end casting (91).An additional weld will be provided for on outside edge (154).

Longitudinal centerline (155) of upper rod guide (110) and longitudinal centerline (156) of lower rod guide (143) to intersect end casting centerline (157) by approximately 20 degrees providing for parallel orientation of upper rod guide (110) with lower rod guide (143) and providing for an approximately horizontal plane and proper alignment for tension rod (90) to pass substantially through upper rod guide (110) and maintain axial alignment for mating with lower rod guide (143) on end casting (91) and tension rod bearing (88) on hinge tube (34).

Figure 11:
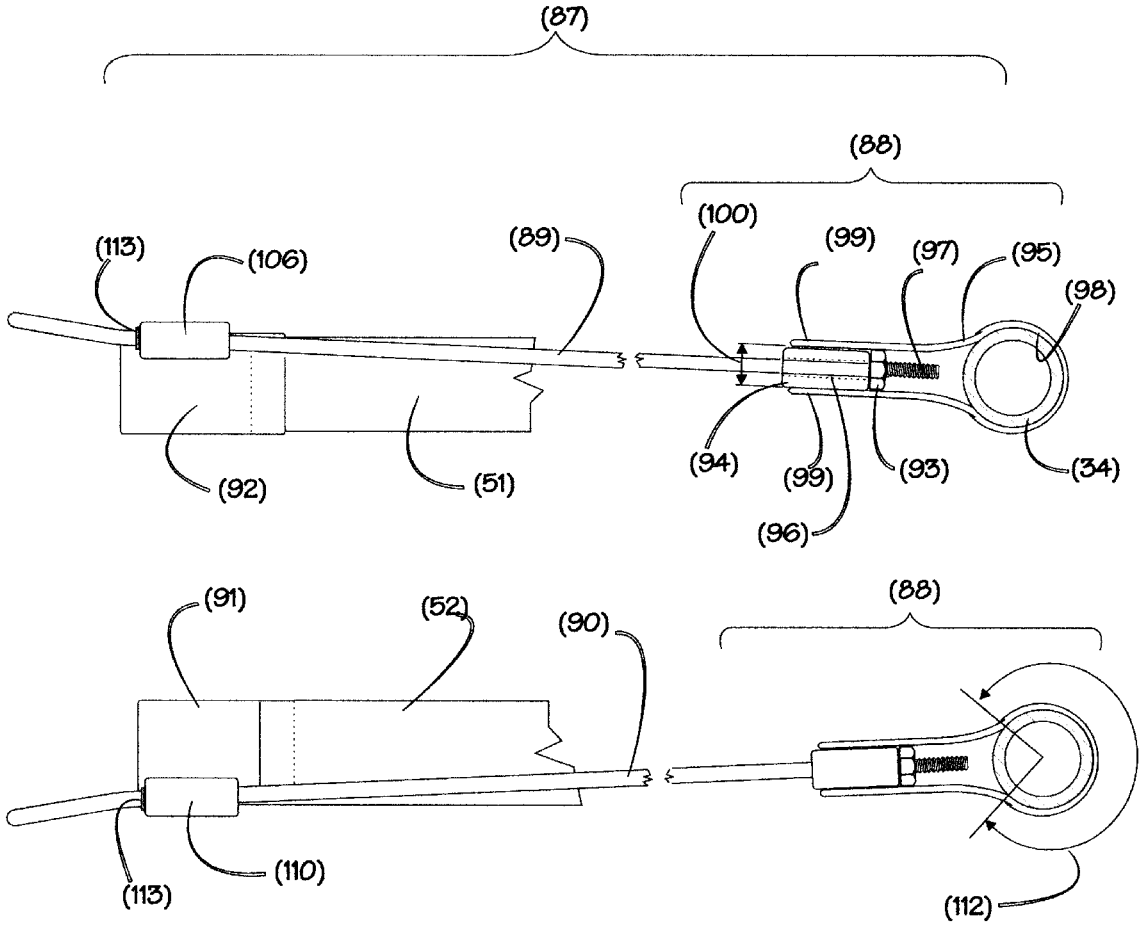

Referring now to FIG. 11

A tension rod arrangement (87) is provided to limit deflection and add support to each of the two swing booms while swing booms are under load. Tension rod arrangement comprise two tension rod bearings (88), outside tension rod (89) and inside tension rod (90). Tension rod bearings (88) for outside swing boom tension rod (89) and inside swing boom tension rod (90) are identical. Tension rods (89) and (90) are unique to respective outside swing boom (51) and inside swing boom (52) in respect to how they mate with outside swing boom end casting (92) and inside swing boom casting (91).

As tension rod bearing (88) specifications are identical for outside swing boom tension rod (89) and inside boom tension rod (90), a singular detailed description format will be Utilized.

Tension rod bearing (88) to be provided with tension adjustment nut (93) and allow for pivotal attachment of tension rods (89) and (90) to hinge tube (34) in frame (1)

Tension rod bearing (88) comprised of barrel (94) and strap (95). Barrel (94) constructed from 1 ⅛" diameter stainless steel bar stock approximately 3" in length. Barrel (94) to be provided for clearance hole (96). Clearance hole (96) to pass substantially through axial center of barrel (94) to allow threaded end (97) of tension rods (89) or (90) to pass through Barrel (94) and be mated with internal threaded portion of adjusting nut (93). Tension rod bearing strap (95) to be constructed of ¼" thick stainless steel rectangular bar stock approximately 1" wide and 16" long. Strap (95) to form a substantially 270 degree round geometry to provide approximately 2" inside diameter bearing surface (98) for mating with outside diameter of hinge tube (37). Strap tangs (99) are provided for mating strap (95) to barrel (94). Strap tangs (99) to be parallel to each other for a length of approximately 2 ½" maintaining a 1 ⅛" clearance (100) over the 2 ½ length Clearance (100) providing for inside surface (99) of strap tangs (95) to mate with outside diameter of barrel (94). Barrel (94) to be substantially welded to strap tangs (95) to form tension rod bearing.

Figure 12:
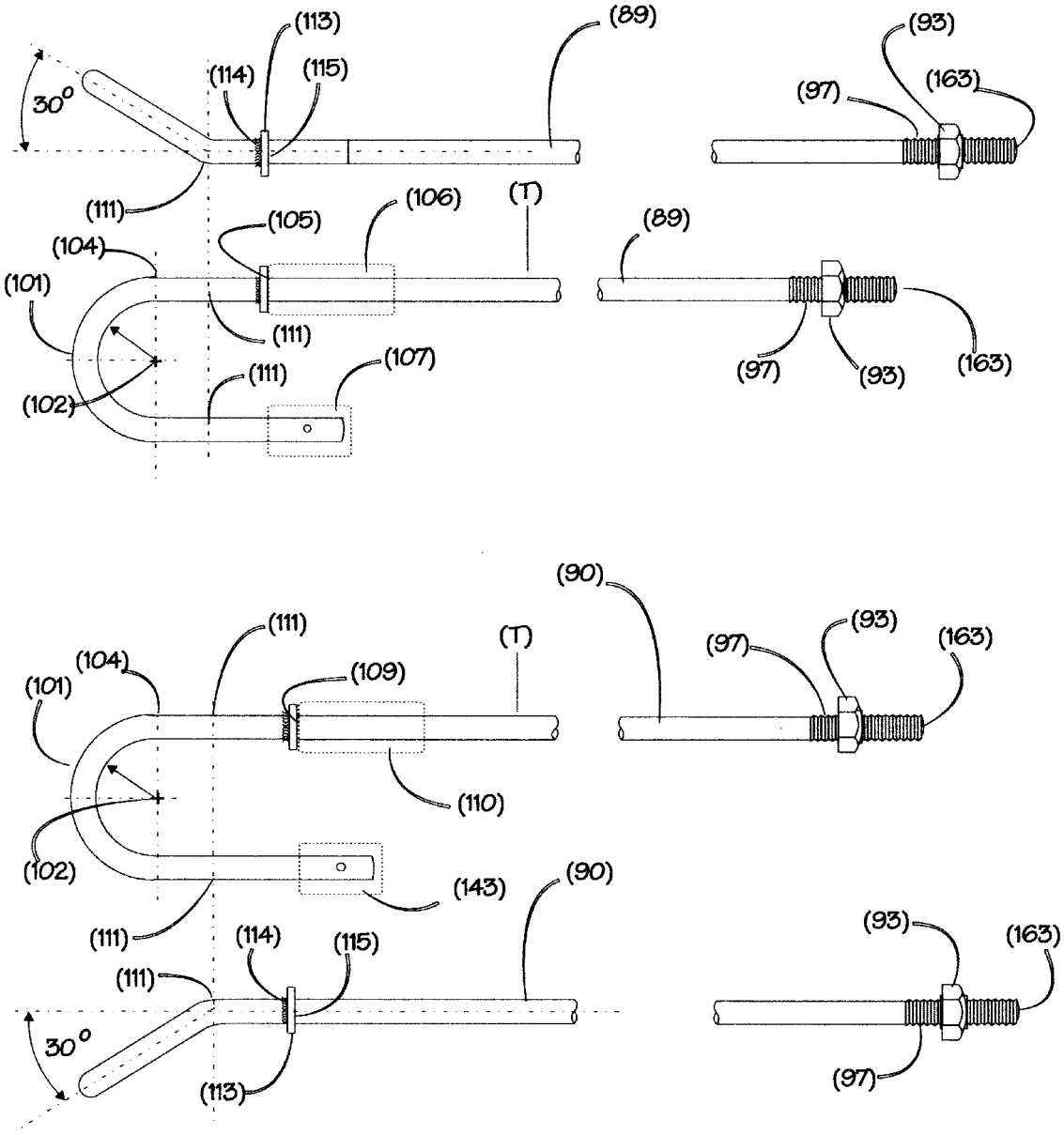

Referring now to FIG. 12

Tension rods (89) and (90) are constructed of ⅝" stainless steel rod stock and are identical except for direction of 30 degree bend (111) and location of stop (113) Total length of the tension rods prior to forming bends is approximately 65". One end of tension rod is substantially threaded (97) for a distance of approximately 2" to provide for threaded attachment of adjustment nut (93). The opposite end comprises the bend to provide for lifting bridal (LB) hanger (101). Hanger (101) bend start point (104) to be approximately 54" from face (163) on threaded end (97) of swing boom tension rods (89) and (90). Hanger (101) to be substantially shaped by forming a 180 degree bend in tension rod with inside radius (102) approximately 1 ½.

Outside swing boom (89) tension rod hanger (101) terminates inside bottom rod guide (107) (see FIG.) and is substantially secured with ⅛" compression pin (108) (see FIG. 9). Inside swing boom (52) tension rod (90) hanger (101) terminates inside bottom rod guide (143) of end casting (91) and is substantially secured with ⅛" compression pin (108) (see FIG. 10)

A stop (113) is provided on each tension rod for the purpose of fixing the position of the tension rods relative to the end castings providing for tension rod adjustment with tension rod adjustment nuts (93).

Stops (113) comprise stainless steel washers substantially welded to tension rods around the full diameter of the washer and tension rod mating surface. Weld is to be preformed on outside face (114) of stops (113). Inside faces (15) of stops (113) to be substantially flat for proper seating with outside faces (105) and (109) of upper rod guides (106) and (110) on end castings (91) and (92). As inside swing boom (52) and end casting (91) overall length is approximately ¾" less than outside swing boom (51) and end casting )92) Fixing locations for stops (113) are different for each of the two tension rods. Outside tension rod (89) requires face (15) of stop (113) to be affixed approximately 50 ½" from face (163) of threaded end (97) of outside tension rod (89). Inside tension rod (90) face (115) of stop (113) to be affixed approximately 49 ¾" from face (163) on threaded end (97) of tension rod (90). This arrangement provides for alignment of hangers (101) when inside swing boom (52) is nested in outside swing boom (51) and provides for equalizing the effective swing radius Of both swing booms.

Outside and inside swing boom tension rod hangers (101) to have an approximate 30 degree bend substantially across their diameter. Viewed from top (T) 30 degree bend (111) on outside tension rod (89) is to the right. Viewed from the top (T) 30 degree bend (111) on inside tension rod (90) is to the left. Bends (111) to be made at point approximately 2 ½" back from radius start point (104). 30 degree bend provides for additional clearance between hangers (101) when inside swing boom (52) is fully nested into channel cavity (74) of outside swing boom (51).

Referring now to FIG. 13

Assembly sequence for the present invention requires that anti friction bushing (B) be placed between all pivoting components as outlined. Bushing (B) to be of nylon or composition material having an outside diameter of 3", a thickness of ⅛" and an inside diameter of 2 1/16". There are a total of 7 bushings (B) used in the assembly of the present invention. It is important that tension rods (89) and (90) are not assembled into their respective end castings (91) and (92) or tension rod bearings (88) until all other components are assembled into frame (1) and secured with hinge tube (34).

Assembly sequence is as follows.

Place $1^{st}$ bushing (B) on to hinge tube (34), place tension bearing (88) over hinge tube (34), place $2^{nd}$ bushing (B) over hinge tube (34), place remaining tension rod bearing (88) over hinge tube (34) and place $3^{rd}$ bushing (B) over hinge tube (34). Hinge tube (34) is then passed through upper hinge tube bearing (8) followed by $4^{th}$ bushing (B) and into upper outside swing boom (51) bearing (58). The $5^{th}$ bushing (B) is inserted between bottom of bearing (58) and top of inside swing boom bearing (83). A $6^{th}$ bushing (B) is fit between bottom of inside swing boom bearing (83) and top of outside swing boom (51) lower bearing (59) The $7^{th}$ and final bushing (B) is placed between the bottom of outside swing boom (51) lower bearing (59) and lower hinge tube bearing (10). Hinge tube (34) is seated in lower hinge tube bearing (10) and is secured with pin (35).

Swing boom tension rods (89) and (90) are then passed through their respective upper rod guides in end castings (91) and (92) threaded end (97) first insuring that the terminal ends of tension rod hangers (101) line up and seat into their respective lower rod guides (107) and (143) in end castings (91) and (92) as the threaded end (97) passes into and substantially through the barrel (94) of the tension rod bearings (88). Tension rod stops (113) will be seated substantially against faces (105) and (109) of upper rod guides (106 and (110) and for final adjustment. Tension rod threaded ends (97) are then fitted with adjusting nuts (93). Adjusting nuts (93) in tension rod bearings (88) are then tightened to a point where outside swing boom (51) and inside swing boom (52) pivot on hinge tube (34) freely and proper clearance of ¼" is obtained between inside swing boom (52) outside surfaces (75) and outside swing boom (51) inside surfaces (76).

Bumper straps (BS) are omitted from FIG. 13 as their configuration will be unique for the type skiff or boat utilized with the tilt base swing boom skiff lift (200). Approximate attachment points (X) for bumper straps (BS) are indicated on outside Swing Boom (51) and inside swing boom (52). Eye bolts (17) for the attachment of bumper straps (BS) to tilt mount (19) (see FIG. 2) are part of the preferred embodiment as they are required regardless of the type skiff or boat accommodated.

The tilt base swing boom skiff lift outlined in the above description represents a unique and greatly improved means for launching, retrieving or transporting a skiff, tender or dinghy without having to tip the craft up on it's side or permanently obstruct the after section of a yacht to that purpose. The push button actuation of the cable drum motor and tilting of the entire frame of the present invention allowing for complete containment of the skiff until settled in the water; making the launch fast (which will be better in emergencies) easier and safer. Nesting the swing booms and swinging them to one side for storage also provides for better access to the after section or swim step of a yacht while the dinghy or skiff is tied up along side. This feature adds to the functional usability of the swim step area and improves access to a skiff or dinghy in leisure as well as emergency situations.

The foregoing description of the preferred embodiment of the present invention has been presented for the purpose of illustration and description. It is not intended to be exhaustive or to limit the invention to the precise form disclosed. Many modifications and variations are possible in light of the above teaching. It is intended that the scope of the present invention be limited not by this detailed description but rather by the claims appended hereto.

What is claimed is:

1. A tilting frame fold away swing boom skiff lift for launching and retrieving a tender or skiff from a yacht said skiff lift comprising, A pair of nesting swing booms pivotally mounted in a tilting frame where outboard ends of said swing booms provide for means to suspend a small tender or skiff and where said swing booms comprise elongated generally C-shaped channel sections of similar geometry with inboard ends of said C-shaped channel sections having means for pivotal mounting on a common axis in said frame: said swing booms projecting generally outward from said frame; each of said C-shaped channels having different cross sectional dimensions and arranged on said common axis with open sides adjacent providing means for smaller C-shaped channel section to be nested substantially inside said open side of adjacent C-shaped channel section allowing for said pair of nesting booms to pivot generally sidwardly 180 degrees independently of each other or in said nested position with said frame substantially containing said swing booms; to be secured to a tilt mounting member for pivotal movement between said yacht and said frame; said frame comprising a pair of legs, a crossbar member, and motor box; said legs to extend vertically from said tilt mounting member to said crossbar member and angled in and substantially joined at the point where said legs intersect said motor box; said crossbar member to comprise a horizontal member joining said legs approximately midway between said tilt mounting member and point where legs intersect said motor box; said crossbar member to be configured to provide means for receiving the lower end of a hinge tube which passes substantially through said means for pivotal mounting on said C-shaped channel sections of said swing booms and said surfaces of motor box providing means for joining upper ends of said legs and upper support of said hinge tube on said common axis with said C-shaped channel sections and said means for receiving lower end cross bar section and; a means for mounting a motorized cable drum; said motorized cable drum providing means for secure cable attachment of said motorized cable drum system to said yacht where switched control of said motorized cable drum to the in or out direction allows said tilting fold away swing boom skiff lift to tilt back lowering said swing booms and providing means to either launch said skiff onto the water or retrieve said skiff from the water.

2. A Tilting frame fold away swing boom skiff lift as in claim 1 provided with a singular means for limiting the swing angle of the swing booms and providing containment for a skiff or tender while in the loaded position.

3. A tilting frame fold away swing boom skiff lift as in claim 2 where said motorized cable drum is mounted on said yacht with secure attachment of cable end to said point where said legs intersect said frame.

4. A fold away swing boom lift for manipulating loads comprising,

A pair of swing booms mounted in a frame where outboard ends of said swing booms provide for means to suspend a load and where said swing booms comprise elongated members of similar geometry with an in board end of said elongated members having a means for pivotal mounting on a common hinge tube axis in said frame; said swing booms projecting generally outward from said frame; elongated members arranged on said common hinge tube axis allowing for inside surfaces of elongated members to be generally adjacent to each other and allowing for said pair of adjacent swing booms to pivot generally sidwardly 180 degrees independently of each other or with said adjacent faces arranged together to function as one; with said frame substantially containing said swing booms said frame comprising a pair of legs with mounting base, a crossbar member for lower hinge tube support and an upper hinge tube support providing a means for joining an upper portion on said legs; said legs to extend vertically from said mounting base member to said crossbar member angled in and substantially joined at the point where said legs intersect said upper hinge tube support forming a modified H shape structure generally narrow at the top; said crossbar member to comprise a horizontal member joining said legs approximately midway between said mounting base and point where legs intersect said upper hinge tube support; said crossbar member to be configured to provide means for receiving the lower end of a hinge tube which passes substantially through said means for pivotal mounting on said elongated members of said swing booms and said surfaces of said upper hinge tube support providing means for joining upper ends of said legs and upper support of said hinge tube on said common axis with said elongated members and said means for receiving lower end of hinge tube in cross bar section.

* * * * *